US006468103B1

(12) United States Patent
Brower

(10) Patent No.: US 6,468,103 B1
(45) Date of Patent: Oct. 22, 2002

(54) INSULATION DISPLACEMENT CONNECTOR FOR PARALLEL WIRE INSERTION

(75) Inventor: Boyd G. Brower, Keller, TX (US)

(73) Assignee: Corning Cable Systems LLC, Hickory, NC (US)

( * ) Notice: Subject to any disclaimer, the term of this patent is extended or adjusted under 35 U.S.C. 154(b) by 0 days.

(21) Appl. No.: 09/840,493

(22) Filed: Apr. 23, 2001

(51) Int. Cl.[7] ..... H01R 4/24; H01R 4/26; H01R 11/20

(52) U.S. Cl. ..... 439/417

(58) Field of Search ..... 439/417, 411, 439/412, 413, 409, 410, 404, 405

(56) References Cited

U.S. PATENT DOCUMENTS

| | | | | |
|---|---|---|---|---|
| 4,037,905 A | | 7/1977 | Lucas | 439/402 |
| 4,256,359 A | * | 3/1981 | Storck | 439/412 |
| 4,645,285 A | | 2/1987 | Cozzens et al. | 439/395 |
| 4,793,823 A | | 12/1988 | Cozzens et al. | 439/409 |
| 5,537,471 A | | 7/1996 | Smith | 379/412 |
| 5,571,029 A | | 11/1996 | Poissant et al. | 439/412 |
| 5,681,182 A | * | 10/1997 | Reichle | 439/417 |
| 5,863,215 A | | 1/1999 | Debbaut et al. | 439/412 |
| 6,135,805 A | * | 10/2000 | Sowinski | 439/417 |

OTHER PUBLICATIONS

Wieland Electric, Inc. Web Site, 4 pages, Apr. 16, 2001.

* cited by examiner

*Primary Examiner*—Javaid Nasri
(74) *Attorney, Agent, or Firm*—Christopher C. Dremann

(57) ABSTRACT

An insulation displacement connector includes a first member and a second member movable relative to the first member between a first position wherein the second member is electrically connected to the first member and a second position wherein the second member is electrically connected to the first member and to the insulated electrical conductor. The insulation displacement connector is disposed within an internal cavity defined by a non-conductive housing. A stuffer is disposed within the cavity and the insulated electrical conductor is disposed within a wire insertion channel formed in the housing and extending into the cavity. The stuffer is moved in a direction substantially parallel to the insulated electrical conductor so that the second member moves from the first position to the second position in a direction substantially perpendicular to the insulated electrical conductor to establish the electrical connection.

29 Claims, 4 Drawing Sheets

INSULATION DISPLACEMENT CONNECTOR FOR PARALLEL WIRE INSERTION

FIELD OF THE INVENTION

The present invention relates generally to a wire termination device for establishing an electrical connection with an insulated electrical connector. More particularly, the invention is an insulation displacement connector having a stuffer adapted for movement in a direction substantially parallel to the insulated electrical conductor.

BACKGROUND OF THE INVENTION

Electrical circuits, and in particular telecommunications networks, make extensive use of insulation displacement connectors to quickly and easily establish electrical connections with insulated electrical conductors. An insulation displacement connector typically includes a blade portion having a slot defining a pair of opposed, sharp edges that cut through the insulation of the insulated electrical conductor to establish electrical continuity between the insulation displacement connector and the electrical conductor. A stuffer exerts a mechanical advantage on the insulated electrical conductor to move the conductor into engagement with the insulation displacement connector. In telecommunications networks, insulation displacement connectors and stuffers are typically disposed within wire termination devices, such as line modules, protected terminal devices (PTDs), and station protectors, that establish the necessary electrical connections throughout the network. Electrical connections need to be established with, for example, the service provider (also referred to as "Telephone Company" or "Telco") wires, the subscriber (also referred to a "drop") wires, and jumper wires. A great number of wire termination devices are often housed in distribution enclosures, such as network interface devices (NIDs) and building entrance terminals (BETs), affixed to a wall of a building that have significant size and space limitations. As a result, the wire termination devices housed within the enclosure must be designed to be as small as possible, while still providing unobstructed access for a technician to establish the necessary electrical connections during both initial configuration and subsequent reconfiguration, for example, in the field.

It is known to provide an angled face on the stuffer so that a wire insertion channel formed in the wire termination device is readily visible to a technician when establishing an electrical connection between the insulation displacement connector and the insulated electrical conductor. The angled face of the stuffer permits the technician to clearly view the wire insertion channel as the insulated electrical conductor is inserted into the wire termination device. As previously mentioned, a mechanical advantage is necessary to move the insulated electrical conductor into contact with the opposed, sharp edges of the blade portion of the insulation displacement connector. A substantial mechanical advantage may be required to force the insulated electrical conductor into electrical contact with the insulation displacement connector, particularly when the conductor is a heavier gauge wire, such as 18 AWG copper. Accordingly, the mechanical advantage is typically provided by a screw that drives a movable portion of the stuffer against the insulated electrical conductor until the sharp edges of the blade portion of the insulation displacement connector cut through the insulation and the make electrical contact with the conductor. The stuffer screw is preferably positioned perpendicular to the insulated electrical conductor to obtain the greatest mechanical advantage. However, due to the aforementioned size and space limitations of the enclosure, unobstructed access to the stuffer screw and optimum visibility of the wire insertion channel is achieved when the wire insertion channel and the stuffer screw are both oriented in the line of sight of the technician. Heretofore, it has not been possible to position the wire insertion channel and the stuffer screw parallel to one another such that both are oriented in the line of sight of the technician.

Accordingly, it is apparent a need exists for a wire termination device that provides unobstructed access to the stuffer screw and optimum visibility of the wire insertion channel. It is further apparent that a particular need exists for an insulation displacement connector having a stuffer screw adapted for movement in a direction parallel to the insulated electrical conductor to thereby establish an electrical connection between the insulation displacement connector and the conductor.

SUMMARY OF THE INVENTION

A wire termination device is provided for establishing an electrical connection with an insulated electrical conductor. In one aspect of the invention, the wire termination device includes a first member and a second member that is movable relative to the first member between a first, unbiased position and a second, biased position. The second member includes means for stripping a portion of the insulation from the insulated electrical conductor when the second member moves from the first position to the second position. Accordingly, the second member is electrically disconnected from the insulated electrical conductor in the first position and is electrically connected both to the insulated electrical conductor and to the first member in the second position. Preferably, the means for stripping is a slot formed adjacent one end of the second member that defines a pair of opposed, sharp edges for stripping the insulation from the insulated electrical conductor.

In a preferred embodiment, the first member is fixed to the housing of the wire termination device by a conductive fastener. The second member includes a leg portion depending from and resiliently attached to the first member and a blade portion extending outwardly from the leg portion. The wire termination device further includes a stuffer having a cam surface that engages the second member. The stuffer is adapted for movement in a direction substantially parallel to the insulated electrical conductor and the second member is adapted for movement substantially perpendicular to the insulated electrical conductor. As the stuffer is moved downwardly, the cam surface forces the blade portion of the second member into engagement with the insulated electrical conductor. As the stuffer is moved upwardly, the blade portion disengages from the insulated electrical conductor and is returned to the first, unbiased position.

In another preferred embodiment, the first member includes a base portion, a leg portion depending upwardly from the base portion, and a blade supporting portion depending outwardly from the leg portion. The wire termination device further includes a guide attached to the first member. The guide is electrically connected to the first member and to the second member and the second member is movable relative to the guide between the first position and the second position. Preferably, the guide defines an elongate opening for receiving the second member therethrough and a pair of upper contacts disposed within the opening for slidingly engaging the blade portion of the second member. Similarly, the first member includes a lower contact for slidingly engaging the blade portion of the second member. As previously described, the wire termination device further includes a stuffer having a cam surface that engages the second member. The stuffer is adapted for movement in a direction substantially parallel to the insulated electrical conductor and the second member is adapted for movement in a direction substantially perpendicular to the insulated electrical conductor. As the stuffer is moved downwardly, the cam surface forces the blade portion of the second member into engagement with the insulated electrical conductor. As the stuffer is moved upwardly, the blade portion disengages from the insulated electrical conductor and is returned to the first, unbiased position.

In another aspect of the invention, a wire termination device is provided for establishing an electrical connection with an insulated electrical conductor. The wire termination device includes a housing defining an internal cavity and having a wire insertion channel formed therein that extends into the cavity. A portion of the insulated electrical conductor is disposed within the wire insertion channel. An insulation displacement corrector disposed within the cavity includes a first member fixed to the housing and a second member movable relative to the first member between a first, unbiased position and a second, biased position. The second member has a slot formed therein adjacent one end that defines a pair of opposed, sharp edges for stripping a portion of the insulation from the insulated electrical conductor when the second member moves from the first position to the second position. In the first position, the second member is electrically disconnected from the insulated electrical conductor. In the second position, the second member is electrically connected to the insulated electrical conductor and to the first member. The wire termination device further includes a stuffer disposed within the cavity for moving the second member between the first position and the second position. The stuffer is adapted for movement in a direction substantially parallel to the insulated electrical conductor and the second member is adapted for movement in a direction substantially perpendicular to the insulated electrical conductor.

In another aspect of the invention, a method is provided for establishing an electrical connection between an insulation displacement connector and an insulated electrical conductor. The insulation displacement connector is disposed within an internal cavity defined by the housing of a wire termination device. The insulation displacement connector includes a first member and a second member movable relative to the first member between a first, unbiased position and a second, biased position. The second member has a slot formed therein adjacent one end that defines a pair of opposed, sharp edges for stripping a portion of the insulation from the insulated electrical conductor when the second member moves from the first position to the second position. In the first position, the second member is electrically disconnected from the insulated electrical conductor. In the second position, the second member is electrically connected to the insulated electrical conductor and to the first member. The wire termination device further includes a stuffer for moving the second member between the first position and the second position.

In a preferred embodiment, the method includes the first step of positioning the insulated electrical conductor in a wire insertion channel formed in the housing and extending into the cavity defined by the housing of the wire termination device. The method further includes the second step of moving the second member in a direction substantially perpendicular to the insulated electrical conductor from the first position to the second position. In another preferred embodiment, the method includes the first step of positioning the insulated electrical conductor in a wire insertion channel formed in the housing and extending into the cavity defined by the housing of the wire termination device. The alternative preferred method further includes the second step of moving the stuffer in a direction substantially parallel to the insulated electrical conductor so that the second member moves from the first position to the second position.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, the preferred embodiments are provided so that this disclosure will be thorough and complete, and will fully convey the scope of the invention to those of ordinary skill in the art. Like numbers refer to like elements throughout.

Figure 1:
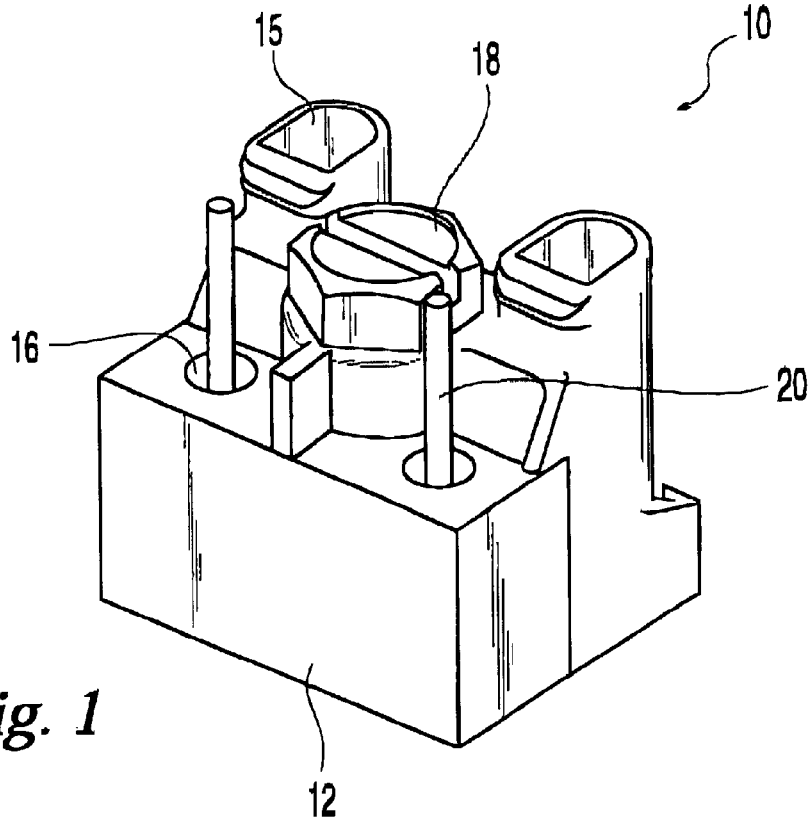
FIG. 1 is a perspective view of a wire termination device according to a preferred embodiment of the invention.
Figure 2:
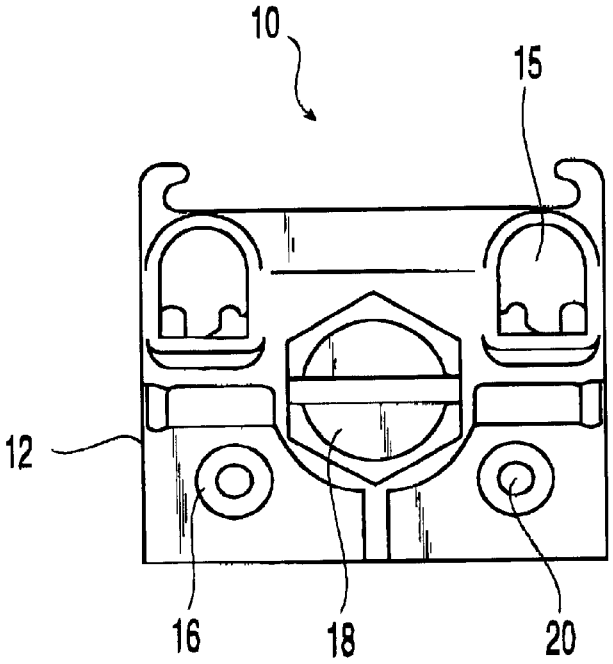
FIG. 2 is a top plan view of the wire termination device of FIG. 1.

Referring now to the accompanying drawings, FIGS. 1 and 2 show a wire termination device, indicated generally at 10, according to a preferred embodiment of the invention. The wire termination device 10 is of a type commonly utilized in a distribution enclosure, such as a network interface device (NID) or building entrance terminal (BET), of a telecommunications network to establish an electrical connection with an insulated electrical conductor. For example, the wire termination device 10 may be a line module, a protected terminal device (PTD), or a station protector positioned within the enclosure to terminate service provider wires, subscriber wires, and jumper wires, and thereby electrically connect respective ones of the service provider wires with respective ones of the subscriber wires or jumper wires. A great number of the wire termination devices 10 are typically housed together in extremely close proximity to one another within a distribution enclosure having significant size and space limitations. As a result, it is imperative to provide sufficient access to each of the wire termination devices 10 so that a technician may establish the necessary electrical connections during both initial configuration and subsequent reconfiguration, for example, in the field.

The wire termination device 10 preferably comprises a housing 12 defining an internal cavity 14 (FIGS. 4, 5, 7 and 8). At least one, and preferably at least two, wire insertion channels 16 are formed in the housing 12 and extend into the internal cavity 14. The wire insertion channels 16 receive an insulated electrical conductor 20 therein for establishing an electrical connection, as will be described. The insulated electrical conductor 20 preferably comprises an inner core made of a conductive material, such as copper wire, surrounded by an outer sheath of a non-conductive, insulating material, such as soft plastic. As known to those of ordinary skill in the art, the insulated electrical conductor 20 may be a service provider wire, a subscriber wire, or a jumper wire electrically connected, for example, to another electronic component within the enclosure. The insulated electrical conductor may have any diameter, but typically has a diameter of between about 18 and about 24 AWG. The wire termination device 10 further comprises a stuffer 18 for establishing the electrical connection with the insulated electrical conductor 20. The stuffer 18 is preferably a conventional stuffer screw having a lower portion 17, as described in greater detail hereinafter. However, the stuffer 18 may be any activating member for moving an insulation displacement connector as prescribed herein, including for example and without limitation, a plunger or a cam activated by a lever. As shown, the wire termination device 10 may also have one or more test ports 15 formed in the housing 12 that extend into the internal cavity 14 for testing the electrical continuity of the electrical connections in a known manner.

Figure 3:
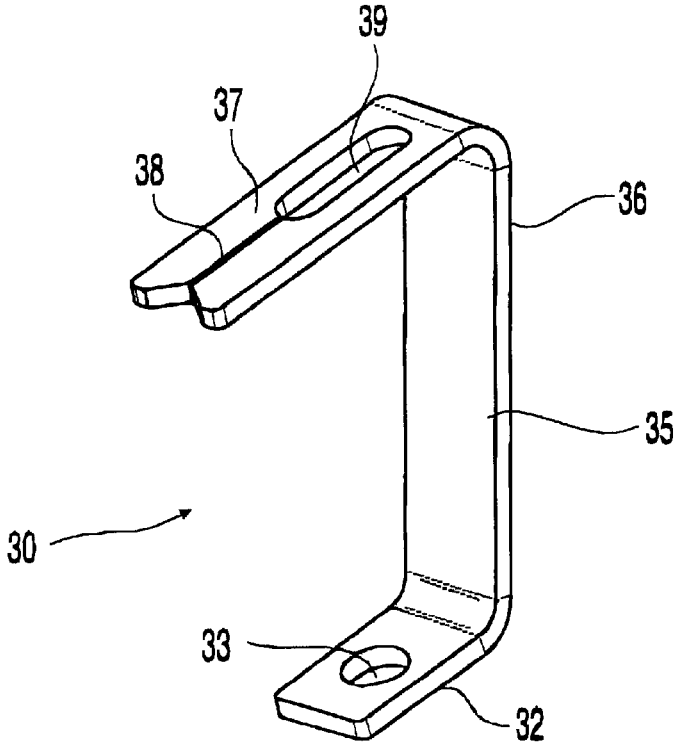
FIG. 3 is a detailed perspective view of a preferred embodiment of an insulation displacement connector adapted to be disposed within the wire termination device of FIG. 1.

A preferred embodiment of an insulation displacement connector, indicated generally at 30, adapted to be disposed within the cavity 14 of the wire termination device 10 is shown in FIG. 3. The insulation displacement connector 30 is made of a conductive material, such as metal, and comprises a first member 32 and a second member 36 depending upwardly from the first member. The first member 32 is adapted to be fixed to the housing 12 of the wire termination device 10 and preferably has a hole 33 formed therethrough for receiving a fastener, such as a screw or rivet, to fix the first member to the housing. In the preferred embodiment shown in FIG. 3, the second member 36 comprises a leg portion 35 resiliently attached to the first member 32 and a blade portion 37 depending outwardly from the leg portion substantially parallel to the first member. The blade portion 37 of the second member 36 has a slot 38 formed therein that defines a pair of opposed, sharp edges for cutting the outer sheath of the insulated electrical conductor 20, as will be described. The blade portion 37 further has an elongated relief 39 formed therein for permitting the slot 38 to open when the blade portion of the insulation displacement connector 30 engages the insulated electrical conductor 20.

As previously mentioned, the leg portion 35 of the second member 36 is resiliently attached to the first member 32. As such, the second member 36 is movable relative to the first member 32 between a first, unbiased position, shown in FIG. 4, and a second biased position, shown in FIG. 5. In the unbiased position, the blade portion 37 of the second member 36 does not engage, and therefore, is electrically disconnected from the insulated electrical conductor 20. However, because the second member 36 depends from and is resiliently attached to the first member 32, the second member is electrically connected to the first member. In the biased position, the second member 36 engages the insulated electrical conductor 20, and therefore, is electrically connected to both the insulated electrical conductor and to the first member 32. Typically, the first member 32 is further electrically connected to a conductive member (not shown) so that the insulated electrical conductor 20 completes an electrical circuit between, for example, a service provider wire and a subscriber wire or a jumper wire in a known manner.

Preferably, the insulated electrical conductor 20 is disposed within the cavity 14 defined by the housing 12 of the wire termination device 10. Similarly, the stuffer 18 of the wire termination device 10 is disposed within the cavity 14 defined by the housing 12. Most importantly, a lower portion 17 of the stuffer 18 extends downwardly into the cavity 14 and the stuffer is adapted for movement in a direction parallel to the wire insertion channel 16 and the insulated electrical conductor 20. The lower portion 17 of the stuffer 18 has a cam surface 19 angled relative to the leg portion 35 of the second member 36. As such, the blade portion 37 of the second member 36 is forced into engagement with the insulated displacement conductor 20 as the cam surface 19 of the stuffer 18 travels downwardly against the leg portion 35 of the second member. In particular, as the lower portion 17 of the stuffer 18 is moved in the direction indicated by the vertical arrow, the blade portion 37 of the second member 36 is forced to move in the direction indicated by the horizontal arrow into a slot 13 formed in the housing 12 of the wire termination device 10 from the first, unbiased position (FIG. 4) to the second, biased position (FIG. 5) As a result, an electrical connection is established between the insulation displacement connector 30 and the insulated electrical conductor 20.

In the event that the wire termination device 10 must be subsequently reconfigured by a technician, for example in the field, the electrical connection may be broken and the insulated electrical conductor 20 removed from the wire insertion channel 16 formed in the housing 12 in any number of ways that are well within the level of ordinary skill in the art. For purposes of example and not limitation, the leg portion 35 of the second member 36 may be provided with one or more outwardly extending flanges that cooperate with a channel or track formed on the cam surface 19 of the lower portion 17 of the stuffer 18. Accordingly, the leg portion 35 of the second member 36 will ride in the track formed on the cam surface 19 as the stuffer 18 is moved downwardly and upwardly in a direction parallel to the wire insertion channel 16, thereby causing the blade portion 37 of the second member 36 to move alternately into and out of engagement with the insulated electrical conductor 20.

Figure 6:
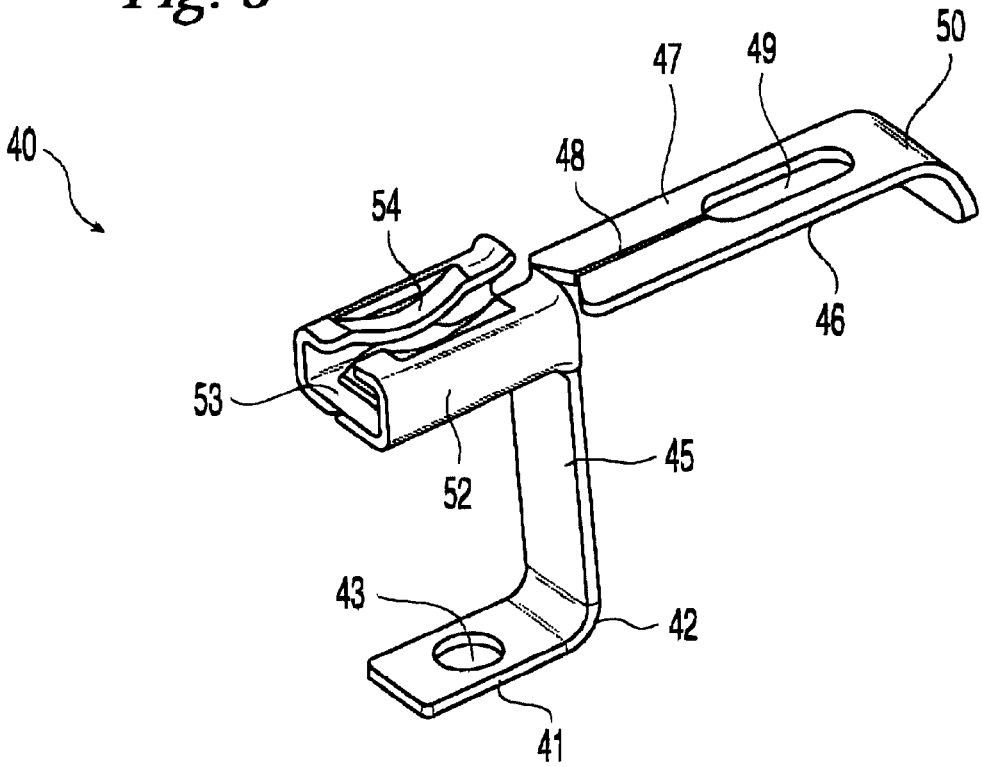
FIG. 6 is an exploded perspective view of an alternative preferred embodiment of an insulation displacement connector adapted to be disposed within the wire termination device of FIG. 1.
Figure 4:
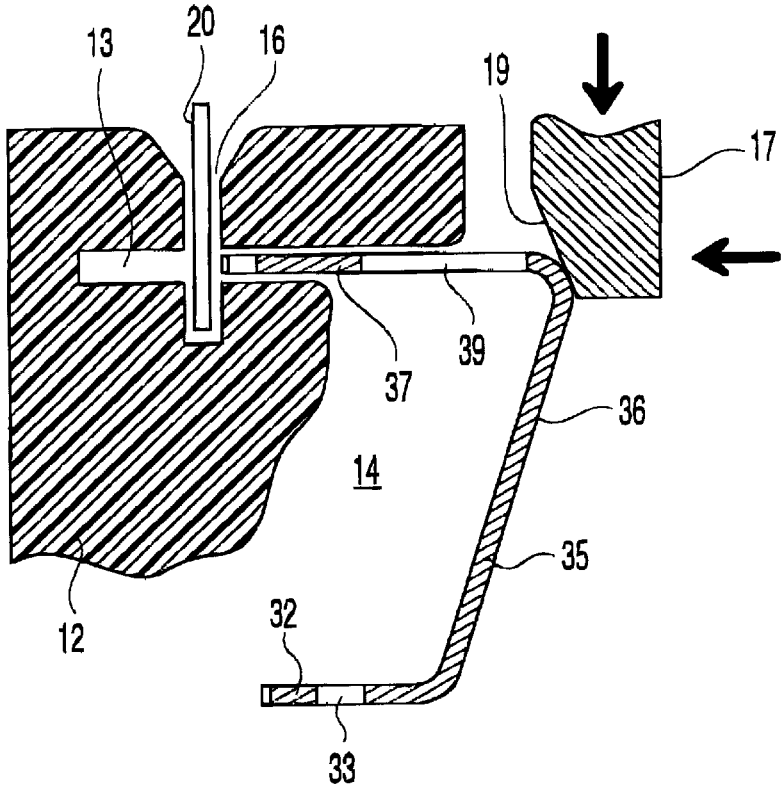
FIG. 4 is a sectional view of the wire termination device of FIG. 1 with the insulation displacement connector of FIG. 3 shown in a first, unbiased position.
Figure 5:
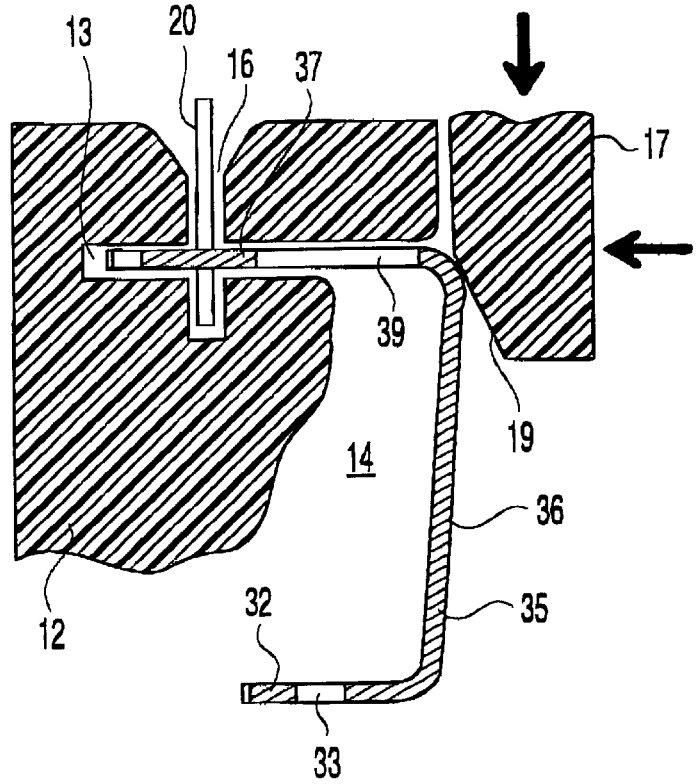
FIG. 5 is a sectional view of the wire termination device of FIG. 1 with the insulation displacement connector of FIG. 3 shown in a second, biased position.

An alternative preferred embodiment of an insulation displacement connector, indicated generally at 40, adapted to be disposed within the cavity 14 of the wire termination device 10 is shown in FIG. 6. The insulation displacement connector 40 is made of a conductive material, such as metal, and comprises a first member 42 and a second member 46 that is movable relative to the first member. The first member 42 is adapted to be fixed to the housing 12 of the wire termination device 10 and preferably has a hole 43 formed therethrough for receiving a fastener, such as a screw or rivet, to fix the first member to the housing. In the preferred embodiment shown in FIG. 6, the first member 42 comprises a base portion 41 and a leg portion 45 depending upwardly from the base portion. As shown, the leg portion 45 is substantially perpendicular to the base portion 41. However, the leg portion 45 may be positioned at any suitable angle relative to the base portion 41 required by the design constraints of the wire termination device 10. The first member 42 further comprises a blade supporting portion 44 (FIGS. 7 and 8) depending outwardly from the leg portion 45, for a purpose to be described. The second member 46 comprises a cam-engaging portion 50 and a blade portion 47 depending outwardly from the cam-engaging portion 50. The blade portion 47 of the second member 46 has a slot 48 formed therein that defines a pair of opposed, sharp edges for cutting the outer sheath of the insulated electrical conductor 20, as previously described. The blade portion 47 further has an elongated relief 49 formed therein for permitting the slot 48 to open when the blade portion of the insulation displacement connector 40 engages the insulated electrical conductor 20.

The insulation displacement connector 40 further comprises a guide 52 that is positioned in an enlarged portion of the slot 13 formed in the housing 12 of the wire termination device 10. The guide 52 has a groove or channel 53 formed therein for receiving the blade portion 47 of the second member 46. As shown, the guide 52 is an elongated, generally hollow tube made entirely of a conductive material, such as metal. However, the guide 52 may have any suitable configuration required by the design constraints of the wire termination device 10 and may be made partially of a non-conductive material, such as plastic. In the preferred embodiment shown and described herein, the guide 52 has at least one, and preferably a pair, of upper contacts 54 (FIGS. 7 and 8) formed on the interior surface for slidingly engaging the upper surface of the blade portion 47 of the second member 46. The lower surface of the blade portion 47 is slidingly supported by a rounded lower contact 55 (FIGS. 7 and 8) provided on the upper surface of the blade supporting portion 44 of the first member 42. Accordingly, the blade portion 47 of the second member 46 is slidingly positioned within the guide 52 between the upper contacts 54 of the guide and the lower contact 55 of the first member 42.

Figure 7:
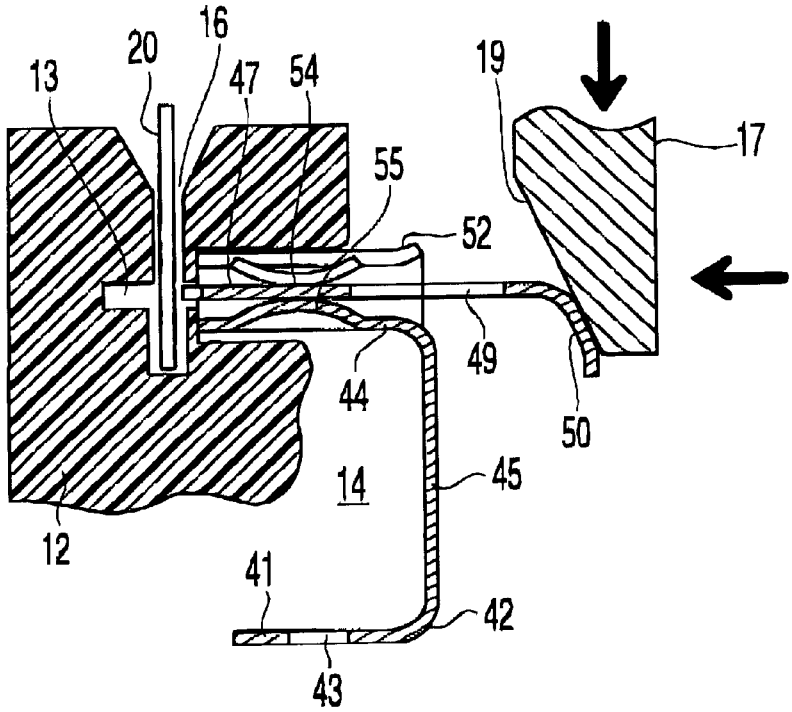
FIG. 7 is a sectional view of the wire termination device of FIG. 1 with the insulation displacement connector of FIG. 6 shown in a first, unbiased position.
Figure 8:
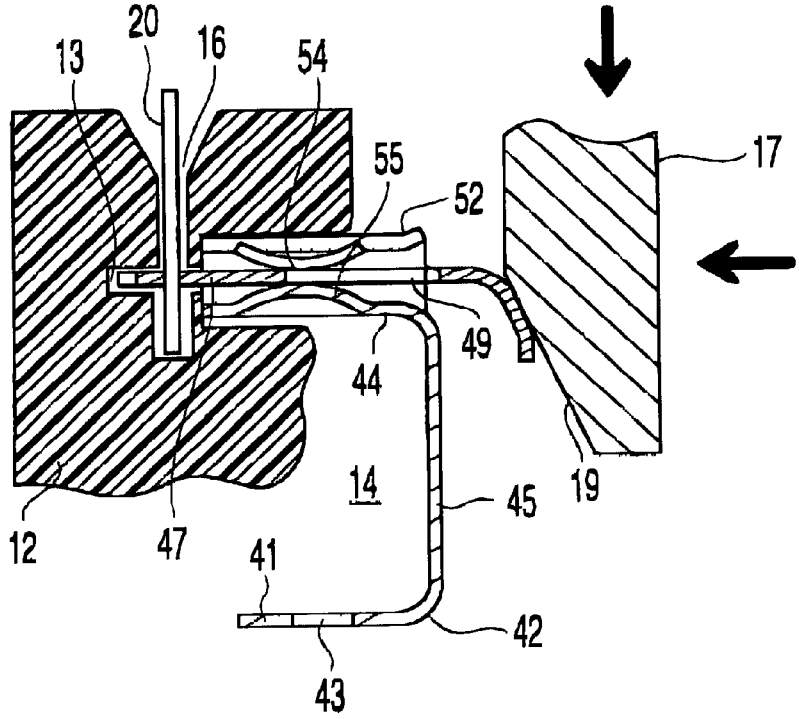
FIG. 8 is a sectional view of the wire termination device of FIG. 1 with the insulation displacement connector of FIG. 6 shown in a second, biased position.

The guide 52 supports the blade portion 47 of the second member 46 in the slot 13 formed in the housing 12 such that the second member is movable relative to the first member 42 between a first, unbiased position, shown in FIG. 7, and a second biased position, shown in FIG. 8. In the unbiased position, the blade portion 47 of the second member 46 does not engage, and therefore, is electrically disconnected from the insulated electrical conductor 20. However, because the second member 46 is supported by the lower contact 55 of the first member 42, the second member is electrically connected to the first member. In the biased position, the second member 46 engages the insulated electrical conductor 20, and therefore, is electrically connected to both the insulated electrical conductor and to the first member 42. Typically, the first member 42 is further electrically connected to a conductive member (not shown) so that the insulated electrical conductor 20 completes an electrical circuit between, for example, a service provider wire and a subscriber wire or a jumper wire in a known manner.

Preferably, the insulated electrical conductor 20 is disposed within the cavity 14 defined by the housing 12 of the wire termination device 10. Similarly, the stuffer 18 of the wire termination device 10 is disposed within the cavity 14 defined by the housing 12. Most importantly, a lower portion 17 of the stuffer 18 extends downwardly into the cavity 14 and the stuffer is adapted for movement in a direction parallel to the wire insertion channel 16 and the insulated electrical conductor 20. The lower portion 17 of the stuffer 18 has a cam surface 19 angled relative to the cam-engaging portion 50 of the second member 46. As such, the blade portion 47 of the second member 46 is forced into engagement with the insulated displacement conductor 20 as the cam surface 19 of the stuffer 18 travels downwardly against the cam-engaging portion 50 of the second member. In particular, as the lower portion 17 of the stuffer 18 is moved in the direction indicated by the vertical arrow, the blade portion 47 of the second member 46 is forced to move in the direction indicated by the horizontal arrow into the slot 13 formed in the housing 12 of the wire termination device 10 from the first, unbiased position (FIG. 7) to the second, biased position (FIG. 8). As a result, an electrical connection is established between the insulation displacement connector 40 and the insulated electrical conductor 20.

In the event that the wire termination device 10 must be subsequently reconfigured by a technician, for example in the field, the electrical connection may be broken and the insulated electrical conductor 20 removed from the wire insertion channel 16 formed in the housing 12 in any number of ways that are well within the level of ordinary skill in the art. For purposes of example and not limitation, the cam-engaging portion 50 of the second member 46 may be provided with one or more outwardly extending flanges that cooperate with a channel or track formed on the cam surface 19 of the lower portion 17 of the stuffer 18. Accordingly, the cam-engaging portion 50 of the second member 46 will ride in the track formed on the cam surface 19 as the stuffer 18 is moved downwardly and upwardly in a direction parallel to the wire insertion channel 16, thereby causing the blade portion 47 of the second member 46 to move alternately into and out of engagement with the insulated electrical conductor 20.

While preferred embodiments of the invention have been shown and described, many modifications and other embodiments of the invention will be readily apparent to one skilled in the art to which this invention pertains having the benefit of the teachings presented in the foregoing description and the accompanying drawings. Therefore, it is to be understood that the invention is not to be limited to the particular preferred embodiments disclosed and that further modifications and other embodiments are intended to be included within the scope of the appended claims. Although specific terms are employed herein, they are used in a generic and descriptive sense only, and not for purposes of limitation.

That which is claimed is:

1. A wire termination device for establishing an electrical connection with an insulated electrical conductor, the wire termination device comprising:

a first member;

a second member movable relative to the first member between a first position wherein the second member is electrically disconnected from the insulated electrical conductor and a second position wherein the second member is electrically connected to the insulated electrical conductor and to the first member, and a guide attached to the first member and to the second member such that the guide is electrically connected to the first member and to the second member;

wherein the second member is movable relative to the guide between the first position and the second position and comprises a slot formed adjacent one end, it slot defining a pair of opposed, sharp edges for stripping at least a portion of the insulation from the insulated electrical conductor when the second member moves from the first position to the second position.

2. A wire termination device according to claim 1 wherein the second member is unbiased in the first position and is biased in the second position.

3. A wire termination device according to claim 2 wherein the second member is resiliently attached to the first member.

4. A wire termination device for establishing an electrical connection with an insulated electrical conductor, the wire termination device comprising:

a first member;

a second member movable relative to the first member between a first position wherein the second member is electrically disconnected from the insulated electrical conductor and a second position wherein the second member is electrically connected to the insulated electrical conductor and to the first member; and a stuffer adapted for moving the second member between the first position and the second position;

wherein the stuffer is adapted for movement in a direction substantially parallel to the insulated electrical conductor.

5. A wire termination device according to claim 4 wherein the second member is adapted for movement in a direction substantially perpendicular to the insulated electrical conductor.

6. A wire termination device according to claim 4 further comprising a housing defining an internal cavity and having a wire insertion channel extending into the cavity, the first member and the second member disposed within the cavity and the first member fixed to the housing, at least a portion of the insulated electrical conductor disposed within the wire insertion channel and at least a portion of the stuffer disposed within the cavity.

7. A wire termination device for establishing an electrical connection with an insulated electrical conductor, the wire termination device comprising:

a housing defining an internal cavity; and an insulation displacement connector disposed within the housing, the insulation displacement connector comprising a first member fixed to the housing;

a second member movable relative to the first member between a first position wherein the second member is electrically disconnected from the insulated electrical conductor and a second position wherein the second member is electrically connected to the insulated electrical conductor and to the first member, the second member having a slot formed therein adjacent one end the slot defining a pair of opposed, sharp edges for stripping a portion of the insulation from the insulated electrical conductor when the second member moves from the first position to the second position; and a guide attached to the first member such that the guide is electrically connected to the first member and to the second member and wherein the second member is movable relative to the guide between the first position and the second position.

8. A wire termination device according to claim 7 wherein the second member is unbiased in the first position and is biased in the second position.

9. A wire termination device according to claim 8 wherein the second member is resiliently attached to the first member.

10. A wire termination device according to claim 7 wherein the guide defines a channel having at least one electrical contact for slidingly engaging the second member.

11. A wire termination device according to claim 7 wherein the guide defines an elongate opening for receiving the second member therethrough and a pair of contacts disposed within the opening for slidingly engaging the second member so that the second member is electrically connected to the guide and to the first member.

12. A wire termination device according to claim 7 further comprising a stuffer disposed within the cavity and adapted for moving the second member between the first position and the second position.

13. A wire termination device according to claim 12 wherein a portion of the insulated electrical conductor is disposed within a wire insertion channel formed in the housing and wherein the stuffer is adapted for movement in a direction substantially parallel to the insulated electrical conductor.

14. A wire termination device according to claim 7 wherein the second member is adapted for movement in a direction substantially perpendicular to the insulated electrical conductor.

15. An insulation displacement connector for establishing an electrical connection with an insulated electrical conductor, the insulation displacement connector comprising:

a first member;

a second member movable relative to the first member between a first position wherein the second member is electrically disconnected from the insulated electrical conductor and a second position wherein the second member is electrically connected to the insulated electrical conductor and to the first member; and a guide attached to the first member such that the guide is electrically connected to the first member and to the second member and wherein the second member is movable relative to the guide between the first position and the second position;

wherein the second member is adapted for movement in a direction substantially perpendicular to the insulated electrical conductor.

16. An insulation displacement connector according to claim 15 wherein the second member has a slot formed therein adjacent one end, the slot defining a pair of opposed, sharp edges for stripping a portion of the insulation from the insulated electrical conductor when the second member moves from the first position to the second position.

17. An insulation displacement connector according to claim 15 wherein the second member is unbiased in the first position and is biased in the second position.

18. An insulation displacement connector according to claim 15 wherein the guide defines a channel having at least one electrical contact for slidingly engaging the second member.

19. An insulation displacement connector according to claim 15 wherein the guide defines an elongate opening for receiving the second member therethrough and a pair of contacts disposed within the opening for slidingly engaging the second member so that the second member is electrically connected to the guide and to the first member.

20. A wire termination device for establishing an electrical connection with an insulated electrical conductor, the wire termination device comprising:

a housing defining an internal cavity;

an insulation displacement connector disposed within the cavity comprising a first member adapted to be fixed to the housing; and a second member movable relative to the first member between a first position wherein the second member is electrically disconnected from the insulated electrical conductor and a second position wherein the second member is electrically connected to the insulated electrical conductor and to the first member; and a stuffer for engaging the second member;

wherein the stuffer is adapted for movement in a direction substantially parallel to the insulated electrical conductor.

21. A wire termination device according to claim 20 wherein the second member has a slot formed therein adjacent one end, the slot defining a pair of opposed, sharp edges for stripping a portion of the insulation from the insulated electrical conductor when the second member moves from the first position to the second position.

22. A wire termination device according to claim 20 wherein the second member is unbiased in the first position and is biased in the second position.

23. A wire termination device according to claim 20 further comprising a guide attached to the first member such that the guide is electrically connected to the first member and to the second member and wherein the second member is movable relative to the guide between the first position and the second position.

24. A wire termination device according to claim 23 wherein the guide defines a channel having at least one electrical contact for slidingly engaging the second member.

25. A wire termination device according to claim 23 wherein the guide defines an elongate opening for receiving the second member therethrough and a pair of contacts disposed within the opening for slidingly engaging the second member so that the second member is electrically connected to the guide and to the first member.

26. A method for establishing an electrical connection between the insulation displacement connector and the insulated electrical conductor of the wire termination device of claim 20, the method comprising the steps of:

positioning the insulated electrical conductor in a wire insertion channel formed in the housing and extending into the cavity; and moving the second member in a direction substantially perpendicular to the insulated electrical conductor from the first position to the second position.

27. A method for establishing an electrical connection between the insulation displacement connector and the insulated electrical conductor of the wire termination device of claim 20, the method comprising the steps of:

positioning the insulated electrical conductor in a wire insertion channel formed in the housing and extending into the cavity; and moving the stuffer in a direction substantially parallel to the insulated electrical conductor so that the second member moves from the first position to the second position.

28. A wire termination device for establishing an electrical connection with an insulated electrical conductor, the wire termination device comprising:

a first member;

a second member movable relative to the first member between a first position wherein the second member is electrically disconnected from the insulated electrical conductor and a second position wherein the second member is electrically connected to the insulated electrical conductor and to the first member; and a guide attached to the first member and to the second member such that the guide is electrically connected to the first member and to the second member;

wherein the second member is movable relative to the guide between the first position and the second position; and wherein the guide defines a channel having at least one electrical contact for slidingly engaging the second member.

29. A wire termination device for establishing an electrical connection with an insulated electrical conductor, the wire termination device comprising:

a first member;

a second member movable relative to the first member between a first position wherein the second member is electrically disconnected from the insulated electrical conductor and a second position wherein the second member is electrically connected to the insulated electrical conductor and to the first member; and a guide attached to the first member and to the second member such that the guide is electrically connected to the first member and to the second member;

wherein the second member is movable relative to the guide between the first position and the second position; and wherein the guide defines an elongate opening for receiving the second member therethrough and a pair of contacts disposed within the opening for slidingly engaging the second member so that the second member is electrically connected to the guide and to the first member.

* * * * *